United States Patent [19]

Ohms

[11] 3,949,892

[45] Apr. 13, 1976

[54] CUSHIONED MAST FOR LIFT TRUCKS

[75] Inventor: Edward J. Ohms, Decatur, Ill.

[73] Assignee: Caterpillar Tractor Co., Peoria, Ill.

[22] Filed: Nov. 29, 1974

[21] Appl. No.: 528,185

[52] U.S. Cl. ..... 214/674; 60/413; 91/420

[51] Int. Cl.[2] ..... B66F 9/20

[58] Field of Search ..... 214/670–674, 214/75 G; 91/420; 60/413, 414; 92/12; 280/489

[56] References Cited

UNITED STATES PATENTS

| | | | |
|---|---|---|---|
| 3,321,216 | 5/1967 | Carter | 280/489 |
| 3,734,326 | 5/1973 | Esser | 214/674 |
| 3,831,492 | 8/1974 | Young | 214/674 |

*Primary Examiner*—Robert J. Spar
*Assistant Examiner*—Lawrence J. Oresky
*Attorney, Agent, or Firm*—Phillips, Moore, Weissenberger, Lempio & Strabala

[57] ABSTRACT

A vibration absorber for lift trucks is provided which acts to cushion the lift mast and counteract the tendency for the truck to engage in forward and rear pitching or loping when the tires encounter a bump or other ground discontinuity. The absorber includes an accumulator hydraulically connected to the mast tilt cylinder which is gas pressurized and a conduit connecting the accumulator with the tilt cylinders. An orifice within the conduit is sized in accordance with the truck as a primary mass and the mast fork load as the secondary mass to achieve the desired shock absorbing and damping effect.

5 Claims, 2 Drawing Figures

CUSHIONED MAST FOR LIFT TRUCKS

BACKGROUND OF THE INVENTION

This invention is directed to a cushioned mast for lift trucks which acts to damp out the loping or pitching characteristics encountered when the truck negotiates a bump or other road discontinuity. More particularly, the invention is directed to a shock absorbing means in the form of an accumulator hydraulically connected to the mast tilt cylinder to permit the load and mast function as a vibration absorber.

Currently, many pneumatic tire and fork lift trucks exhibit a loping or pitching characteristic when traveling over bumps and irregular or rough terrain while carrying a load on forks extending ahead of the vehicle. Typically, a pitching or loping action occurs about the front tires when the truck negotiates a bump or other road discontinuity. The resiliency of the pneumatic tire somewhat absorbs the shock of the bump but also causes the vehicle to pitch or lope about the tires. This pitching or loping may be further aggravated as the rear tire or tires then encounters the same bump by moving in a forward direction of travel.

This pitching or loping action causes several problems. First of all, the action commonly results in insufficient loading on the rear tires which are usually steerable and thereby prevents effective control. As the speed of the vehicle is increased, the tendency to lift off at the rear increases. This severely limits travel speed and thus, vehicle productivity.

Secondly, operator fatigue and discomfort is produced by the severe pitching and loping action. Thirdly, the dynamic action of the load positioned on the lift forks extending from the front of the vehicle and the mass of the vehicle extending rearwardly increases the stress loading imparted on the vehicle components. This increases the chance of vehicle breakdown and consequent lost time for repairs.

Prior attempts to solve the thus-described problem have taken the form of the application of systems similar to that disclosed in U.S. Pat. Nos. 2,672,995 and 3,122,246 in lift trucks. These systems, which basically include installing an accumulator in the lift circuit have not been entirely successful. This is most likely due to the basic geometry of the fork lift truck and mass which differs from that of the bucket and arm arrangements of the aforementioned patent devices. The basic geometry of the fork lift truck produces a nearly pure pitch about the axle of the front wheel which differs from that encountered with the subject devices.

SUMMARY AND OBJECTS OF THE INVENTION

Accordingly, it is an object of this invention to provide an improved means for cushioning a lift truck mast.

It is a further object to provide such a means which damps out loping or pitching of the truck produced by traveling over bumps and other surface discontinuities.

It is a further object to provide such a device which is of simple construction and therefore economic to produce.

The invention takes the form of a gas-charged accumulator in the tilt cylinder circuit. The accumulator is intercommunicated with the tilt cylinders by means of a fluid conduit having a sized orifice disposed therein.

Other objects will become more readily apparent from a review of the following description which makes reference to the accompanying drawings.

DETAILED DESCRIPTION

Figure 1:
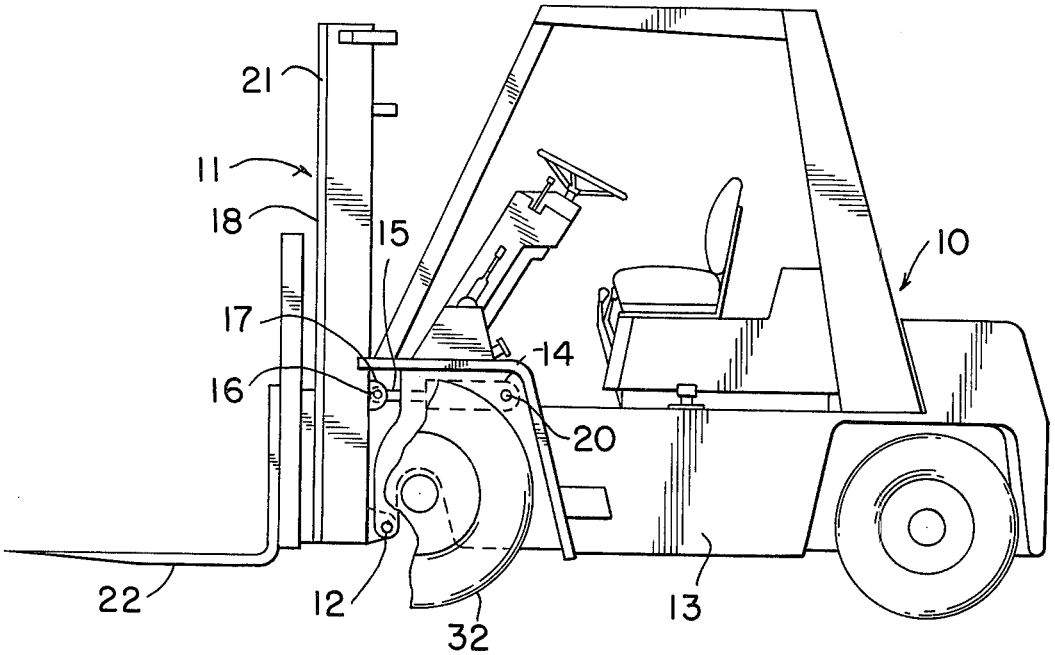
FIG. 1 is a side elevational view of a lift truck showing portions broken away in the area of the mast mounting for purposes of illustration; and, FIG. 2 is a schematic view of the tilt cylinder circuit for tilting the lift mast and showing details of the invention.

Referring now to FIG. 1, there is shown in side elevational view a fork lift truck generally at 10 having a mast assembly 11 pivotally mounted at a pivot 12 to the forward end of the vehicle frame 13. The angle of the mast assembly relative to the vehicle is controlled by a pair of tilt cylinders, one of which is shown at 14. The rod 15 of each cylinder is pivotally connected by a pin 16 to a bracket 17 which is in turn secured to a channel 18 of the mast assembly. The head end 19 is in turn secured to the frame 13 by means of a pin 20. Mast assembly 11 includes a pair of lift masts, one of which is shown at 21, having a pair of forks, one of which is shown at 22, extending forwardly therefrom.

Figure 2:
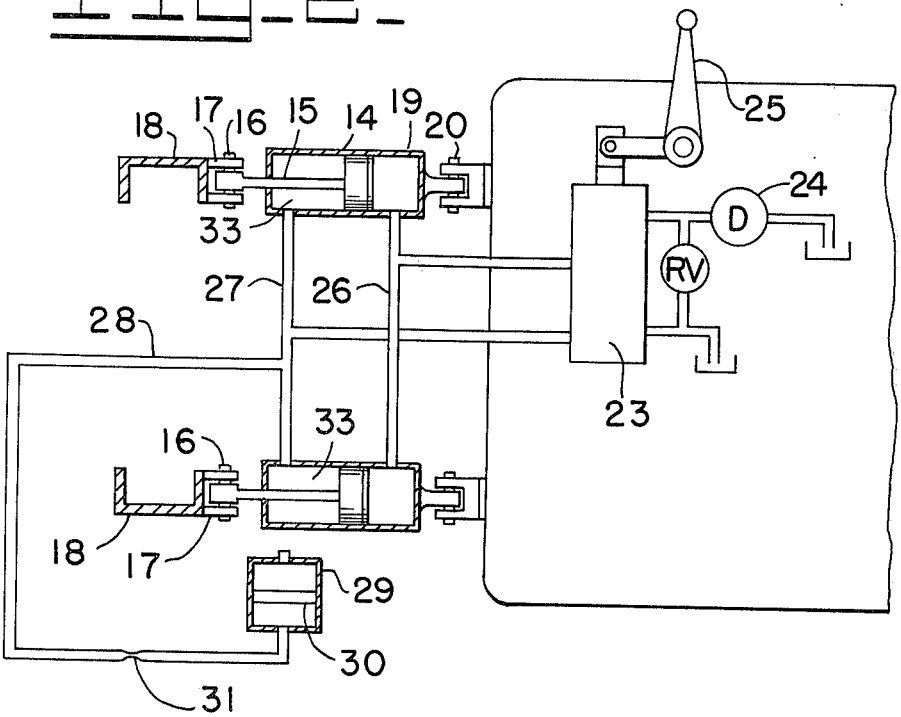

As best seen in FIG. 2, the tilt circuit for actuating the tilt cylinders 14 includes a manually actuable control valve 23 for selectively directing pressurized hydraulic fluid from a pump 24 by means of a handle 25 which is shown in its central, neutral position. Fluid is directed alternatively through conduit 26 to the head end of both of cylinders 14 or through conduit 27 to the rod end of the cylinders. In order to damp out undesired loping or pitching, a damping means in the form of a conduit 28 connected to one end of a gas-charged accumulator 29 having a floating piston 30 therein is provided. Conduit 28 has a restrictive, fixed orifice 31 disposed therein.

In operation, when the front tires 32 of the lift truck encounter a bump or other surface discontinuity such as an elevational rise in the surface, a rock, a board, etc., while traveling in the forward, or roading phase, the dynamic forces of the load mounted on the forks 22 cause a momentary fluid pressure increase in the chambers 33 formed in the rod ends of the tilt cylinders 14. This is due to the fact that the load (not shown) carried upon the fork acts downwardly, causing the mast 21 to be pivoted forwardly about pivot 12. This, of course, causes a compression of the fluid in chambers 33 and an increase of fluid pressure therein. However, due to the presence of the accumulator 29, the momentary fluid pressure increase can be dissipated through conduit 28 and orifice 31 into accumulator 29 where it acts against piston 30. The transfer of a portion of the fluid in chambers 33 to accumulator 29 permits the mast 21 to pitch forward relative to the truck as the tires and thus the forward end of the truck moves upwardly over the bump.

As the tires 32 ride up over the bump and drop down, the fluid pressure in chambers 33 at the rod end of the tilt cylinders decreases due to a reversal of the forces acting on the load, thereby permitting transfer of fluid from the accumulator back to chambers 33 and permitting the mast 21 to pitch rearwardly relative to the truck. It is readily apparent that the forward and rearward pitching of mast 21 thus provided is in opposition to the rocking or loping motion of the truck itself and thus the unwanted pitching or loping is effectively dampened.

The accumulator and orifice are sized by considering the truck body and mast and load as vibration systems. The truck is considered the primary mass while the mast fork and load are considered the secondary or absorber mass. The primary and secondary masses are in opposition on opposite sides of the front wheels 32 which act as the pivot point. The accumulator and orifice are sized in accordance with these primary and secondary masses to achieve the desired shock absorbing and damping effect.

A similar operation occurs if the bump encountered by the front tires is a depression or hole rather than a raised discontinuity. The operation is merely the reverse, wherein the initial reaction is that the mast pitches rearwardly toward the truck body as the tires drop into the hole with the mast then pitching forwardly as the tires hit bottom and rise out of the hole. In either case, the system will serve to damp out the vibration.

It is to be understood that the foregoing description is merely illustrative of a preferred embodiment of the invention and that the scope of the invention is not to be limited thereto, but is to be determined by the scope of the appended claims.

What is claimed is:

1. In a fork lift truck having a body defining front and rear ends, a lift mast assembly pivotally mounted to the forward end, said lift mast assembly including a lift mast and a pair of lift forks extending therefrom and mounted for vertical motion relative to said lift mast, and tilt cylinder means including tilt cylinders for tilting the lift mast relative to the body, a hydraulic control system for actuating said tilt cylinders including a source of fluid pressure, valve means for selectively directing fluid from said source of fluid pressure to the head and rod ends of said tilt cylinders so as to cause tilting of the lift mast relative to the body, wherein the improvement comprises hydraulic-pneumatic damping means communicating with said tilt cylinders for damping pressure surges in said cylinders and thereby minimizing pitching or loping of the vehicle caused by surface discontinuities encountered by the vehicle when in the roading phase, wherein said damping means comprises an accumulator a portion of which contains a pneumatic fluid and conduit means intercommunicating said accumulator with one end of said tilt cylinders, and a restrictive orifice in said conduit means.

2. The invention of claim 1 wherein said accumulator includes a free-floating piston therein.

3. The invention of claim 1 wherein said mast assembly includes a pair of masts and wherein the rod ends of said lift cylinders are pivotally connected to said masts by pivot means.

4. The invention of claim 3 wherein said pivot means include a bracket mounted on said masts and a pivot pin interconnecting said bracket with the rods of said tilt cylinders.

5. The invention of claim 1 wherein said orifice is a fixed orifice.

* * * * *